US006006484A

United States Patent [19]

Geissbühler

[11] Patent Number: 6,006,484

[45] Date of Patent: Dec. 28, 1999

[54] SOUND-DAMPING PARTITION

[75] Inventor: Michael Geissbühler, Kriens, Switzerland

[73] Assignee: Sika AG, Switzerland

[21] Appl. No.: 09/011,229

[22] PCT Filed: Jun. 22, 1996

[86] PCT No.: PCT/EP96/02723

§ 371 Date: Feb. 5, 1998

§ 102(e) Date: Feb. 5, 1998

[87] PCT Pub. No.: WO97/06318

PCT Pub. Date: Feb. 20, 1997

[30] Foreign Application Priority Data

Aug. 5, 1995 [DE] Germany ..... 195 28 825

[51] Int. Cl.[6] ..... E04C 2/34

[52] U.S. Cl. ..... 52/481.1; 52/793.11; 52/479

[58] Field of Search ..... 52/793.11, 794.1, 52/480, 479, 407.1, 407.3, 144, 481.1; 181/284, 290, 294

[56] References Cited

U.S. PATENT DOCUMENTS 4,069,640 1/1978 Dawdy ..... 52/746
4,077,168 3/1978 Smith ..... 52/481.1
5,749,187 5/1998 Umehara et al. ..... 52/407.3

FOREIGN PATENT DOCUMENTS 714399 11/1941 Germany .
469182 5/1993 Sweden .

OTHER PUBLICATIONS

Polynorbornene—a problem solver for the 80's by Barun Dutt; European Rubber Journal Oct. 1979.

*Primary Examiner*—Carl D. Friedman
*Assistant Examiner*—Dennis L. Dorsey
*Attorney, Agent, or Firm*—Pendorf & Cutliff

[57] ABSTRACT

The invention relates to a sound-damping partition, especially for the internal equipment of buildings. The partition consists essentially of a timer sub-frame (10) and two sets of planting (18, 20) on either wide side (12, 14) of the sub-frame (10) leaving a hollow space (16) filled with air and damping materials (36). To obtain improved airborne sound damping suing simple means, the invention proposes that one of the sets of planking (20) be secured to the sub-frame (10) by means of thick-walled, soft elastic beads of adhesive (32) while the other set of planting (18) is rigidly clamped to said sub-frame (10).

27 Claims, 4 Drawing Sheets

SOUND-DAMPING PARTITION

BACKGROUND OF THE INVENTION

1. Field of the Invention

The invention is related to a sound-damping partition wall, especially for interior structures in buildings, comprising a sub-frame preferably designed to be a wooden frame or post construction, and two sets of planking on either broad side of the sub-frame, leaving therebetween a hollow space filled with air and/or damping material.

2. Description of the Related Art

In known partition walls of this type the planking is connected by mechanical means such as staples, nails, or screws to the wooden sub-frame. The acoustic damping values of such partition walls is not satisfactory, though, even when using thick-walled multiple planking. The sound attenuation that can be achieved therewith is in the order of 46 dB. An improvement of the damping values was in the past only possible with sub-frames in which the posts were replaced by profiled posts made of metal. The sound damping is therein improved by the internal elasticity of the profiled posts, which dampens the flexural vibrations, which are mainly responsible for the transmission of sound, when the planking is rigidly coupled to the posts. In the metal sub-frames it is found to be disadvantageous, though, that these, as opposed to the wooden sub-frames, cannot be used as load bearing walls. Therefore metal sub-frames are not liked to be used especially in the construction of prefabricated houses, more so since it would not fit into the production process of the building company which is usually equipped to work with wood.

Based on this it is the object of the invention to improve a partition wall of the type described above such that an increased sound-damping can be achieved with simple means.

SUMMARY OF THE INVENTION

The solution according to the invention is based on the idea that the sound decoupling between the two plankings and the sub-frame can be improved when the two plankings can vibrate independently from each other. In order to achieve this, it is proposed according to the invention that at least one set of the planking is connected to the sub-frame by means of thick, softly elastic adhesive beads. The other planking is expediently connected rigidly to the sub-frame, preferably by means of staples, nails or screws, and thereby serves as a reinforcement plane for the static calculation.

An adhesive which has a shear modulus of 0.1 to 0.3 $N/mm^2$ at room temperature has proven to be especially advantageous. This value as well as the hardness according to the invention of 10 to 30 Shore (A) is very low compared to the adhesives usually used in wood connections and corresponds more to the values of elastic sealant materials. Due to the fact that the wall thickness of the adhesive beads corresponds to approximately 0.3 to 1.2 times their width and is about 3 to 10 mm in actual application cases, a certain amount of shear deformation within the adhesive beads has to be taken into account due to the weight of the planking.

In order to keep the shear deformation within acceptable limits, it is proposed according to a preferred embodiment of the invention that the adhesive surface areas A of the adhesive beads are dimensioned such that under the influence of the weight of the planking a shear deformation of the adhesive beads of 5 to 25% of the bead thickness results. In other words, the adhesive surface area of the adhesive beads as a function of a unit area of the planking is advantageously $$A=1/\mu\times F/G$$

with $\mu$=0.05 to 0.25, wherein F denotes the weight per unit area of the planking, G the shear modulus of the adhesive and $\mu$ the shear deformation of the adhesive beads as a function of the bead thickness at room temperature.

For a given bead size having an adhesive surface area A' per bead the number of beads per surface unit can be determined to be $$n=1/\mu A'\times F/G$$

with $\mu$=0.05 to 0.25.

The adhesive beads have on both contact sides essentially rectangular adhesive surfaces, wherein the aspect ratio between the long and the short side is expediently chosen to lie between 4:1 and 16:1. Advantageously, the long sides of the adhesive beads are vertically aligned with respect to the sub-frame and disposed vertically spaced with respect to each other on the vertical posts of the sub-frame. Two laterally spaced rows of adhesive beads may be disposed on each post of the sub-frame, wherein adjacent adhesive beads of the two rows of adhesive beads can be staggered in a zig-zag fashion with respect to each other.

Double-sided foam adhesive strips disposed vertically on the posts of the sub-frame and acting as an aid during assembly may be provided in addition to the adhesive beads, which has a spacer function apart from keeping the planking in place until the adhesive beads have set. The adhesive beads are applied to the sub-frame in the form of triangular beads with the tip protruding over the adhesive foam strips, and are deformed to the wall thickness of the adhesive foam strips when the planking is mounted, wherein the adhesive surface at the tip side is broadened.

Since the shear modulus of the adhesive decreases with increasing temperature and the shear deformation increases accordingly due to the own weight, a stop shoulder 40 for the glued planking can be disposed on the sub-frame as a safety measure, which stop shoulder is either elastically resillient or which is disposed below the lower edge of the glued planking projecting a distance corresponding to at least the bead thickness.

The adhesive is expediently chosen from the group of polyurethane adhesives, silicone adhesives, butylene adhesives or a mixture of these adhesives, while the plankings may consist of or are composed of gypsum plaster boards, gypsum fiber boards, particle boards or plywood boards.

BRIEF DESCRIPTION OF THE DRAWINGS

In the following the invention is further described with reference to an embodiment schematically shown in the drawing, in which.

DETAILED DESCRIPTION OF THE INVENTION

Figure 1:
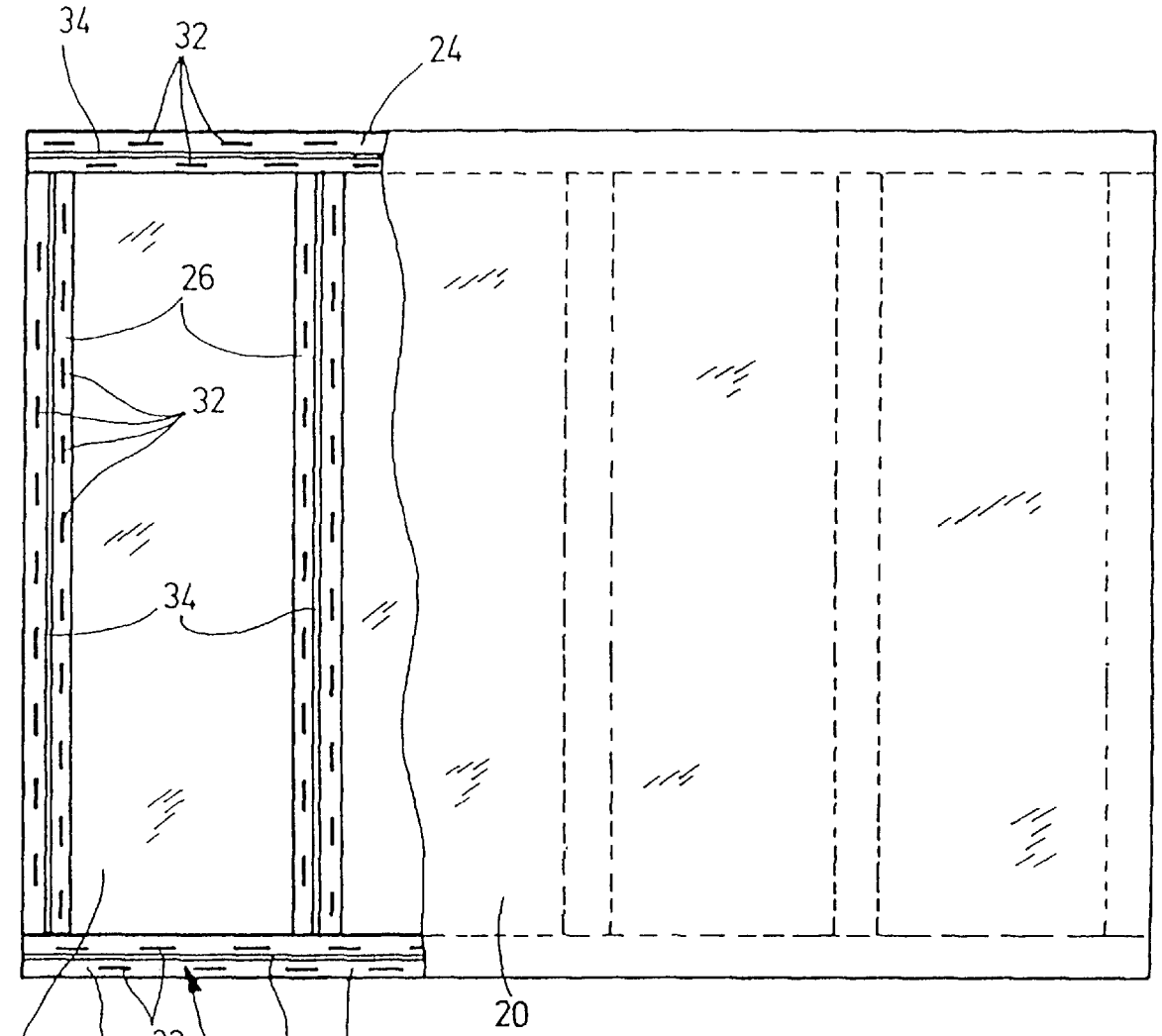
FIG. 1 shows a broad side view of a sound-damping partition wall with a partially broken away front planking.

The sound-damping partition wall shown in FIG. 1 is intended to be used for the interior construction of prefabricated houses. It consists essentially of a sub-frame 10 designed as a wooden frame and two plankings 18, 20 mounted thereto at the broad sides 12, 14, with an air filled hollow space 16 formed therebetween. The frame forming the sub-frame 10 comprises a lower beam 22, an upper beam 24 and a plurality of posts 26 extending between the lower and upper beams and rigidly connected thereto. The plankings 18 and 20 are each made of two gypsum plaster boards and/or plywood boards which lie plane against each other and which are rigidly connected to each other by staples 28, 30 or other mechanical fasteners. The planking 18 is rigidly connected to the sub-frame 10 by means of the sufficiently long staples 28, while the planking 20 is connected to the sub-frame 10 by means of soft-elastic, thick-walled adhesive beads 32. In order to make the assembly of the glued planking easier, double-sided adhesive foam strips 34 are additionally provided, which serve as spacers and immediate fixing of the planking 20 to the sub-frame 10 until the adhesive beads 32 have set. The adhesive beads 32, which preferably consist of a polyurethane adhesive, are applied to the horizontally positioned sub-frame in the form of triangular beads with their tips protruding over the adhesive foam strips 34 and are deformed to their rectangular cross section according to FIG. 2*a* when the planking 20 is put on.

Figures 2A, 2B:
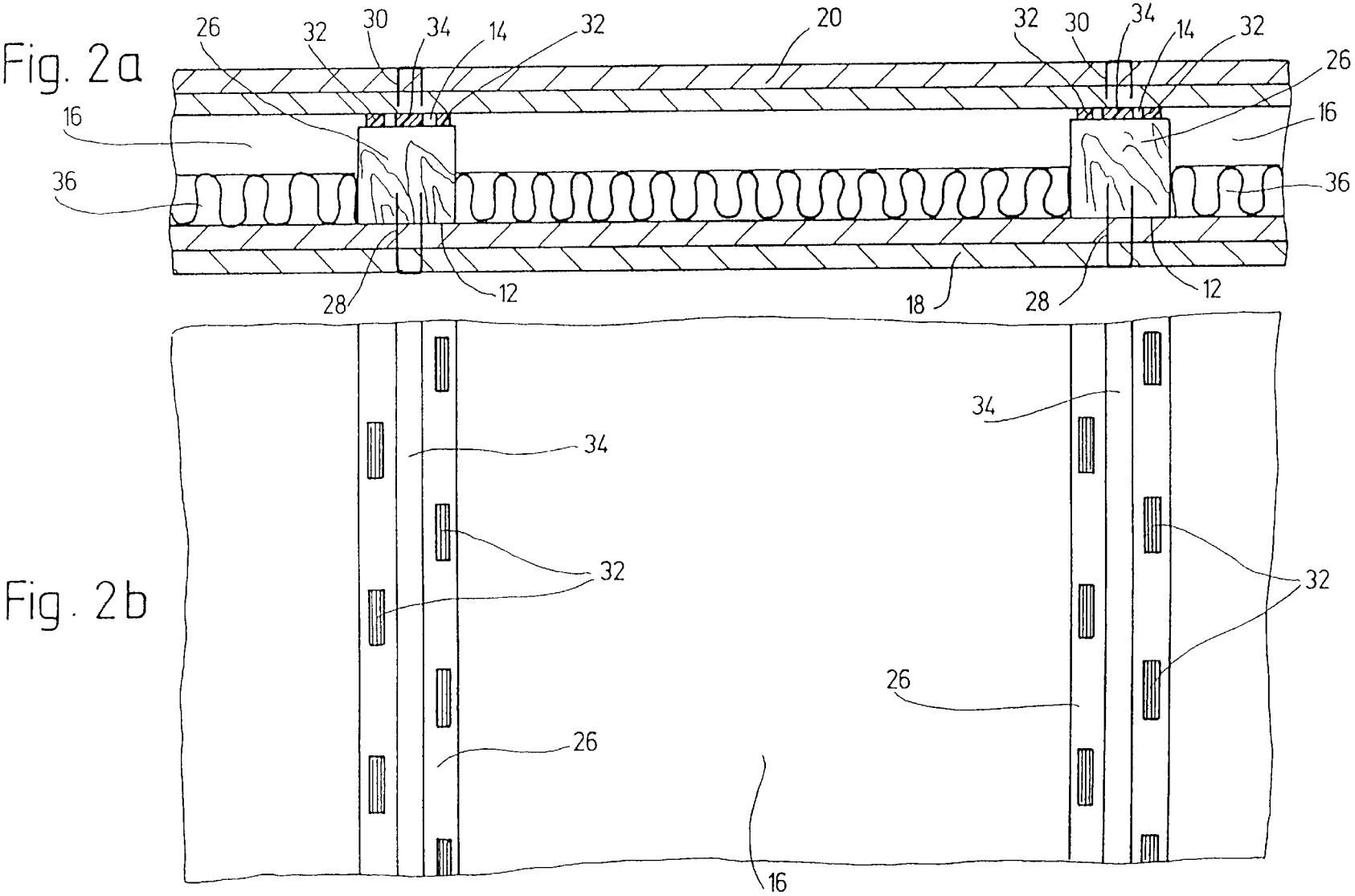
FIGS. 2*a* and *b* show a cross section and a plan view of an enlarged detail of the partition wall of FIG. 1 with the front planking removed.

In the embodiment of FIG. 2*a* the hollow space 16 is partially filled with an insulating mat 36 consisting, for instance, of glass fiber material.

EXAMPLE

For the production of a sound-damping partition wall a frame construction made of wood with square wood posts having sides of 80 mm length and being arranged at distances of 62.5 cm from each other is rigidly stapled at one broad side 14 to a double planking made of 12.5 mm thick gypsum plaster boards and glued on the other side to a similarly constructed planking consisting of two 12.5 mm thick gypsum plaster boards by means of adhesive beads 32 and an adhesive foam strip 34. The 70 mm long and 8 mm wide adhesive beads are applied as triangular beads with a tip height of 12 mm to the post surfaces 14 in the zig-zag shape shown in FIG. 2*b* on the left and right side of the corresponding adhesive foam strip 34. The same procedure is carried out on the upper and lower beams 22, 24. A two component polyurethane adhesive (SikaBond VP200195)is used as the adhesive, which is applied in pasty form. When the planking 20 is mounted, the adhesive beads 32 are deformed to the thickness (6 mm) of the double-sided adhesive foam strip 34 which acts as a spacer.

The shear modulus of the adhesive used was G=0.19 $N/mm^2$ in the set state. The adhesive area A' of each bead was 70 mm×8 mm=560 $mm^2$.

The breaking elongation of the adhesive used was more than 500%, while the breaking elongation of glued gypsum plaster boards is more than 150%.

The admissible shear deformation by the own weight of the planking was assumed to be $\mu$=0.1, which corresponds to an admissible shear deformation of 0.6 mm for a bead thickness of 6 mm. The admissible deformation depends on visual inspection (usability) and on the maximum deformability of the connections (in this case gypsum). Thus there is at worst a 15-fold breaking security.

From these values the adhesive surface area of the adhesive beads amounts to $$A=F/(0.1\ G)$$

wherein A denotes the adhesive area in $mm^2/m^2$, F the area eight of the planking in $N/m^2$, and G the shear modulus of the adhesive (here G=0.19 $N/mm^2$).

The number of adhesive beads per square meter planking is calculated to be $$n=A/A'$$

wherein A' denotes the adhesive surface area of each bead (here 560 $mm^2$).

Figure 3:
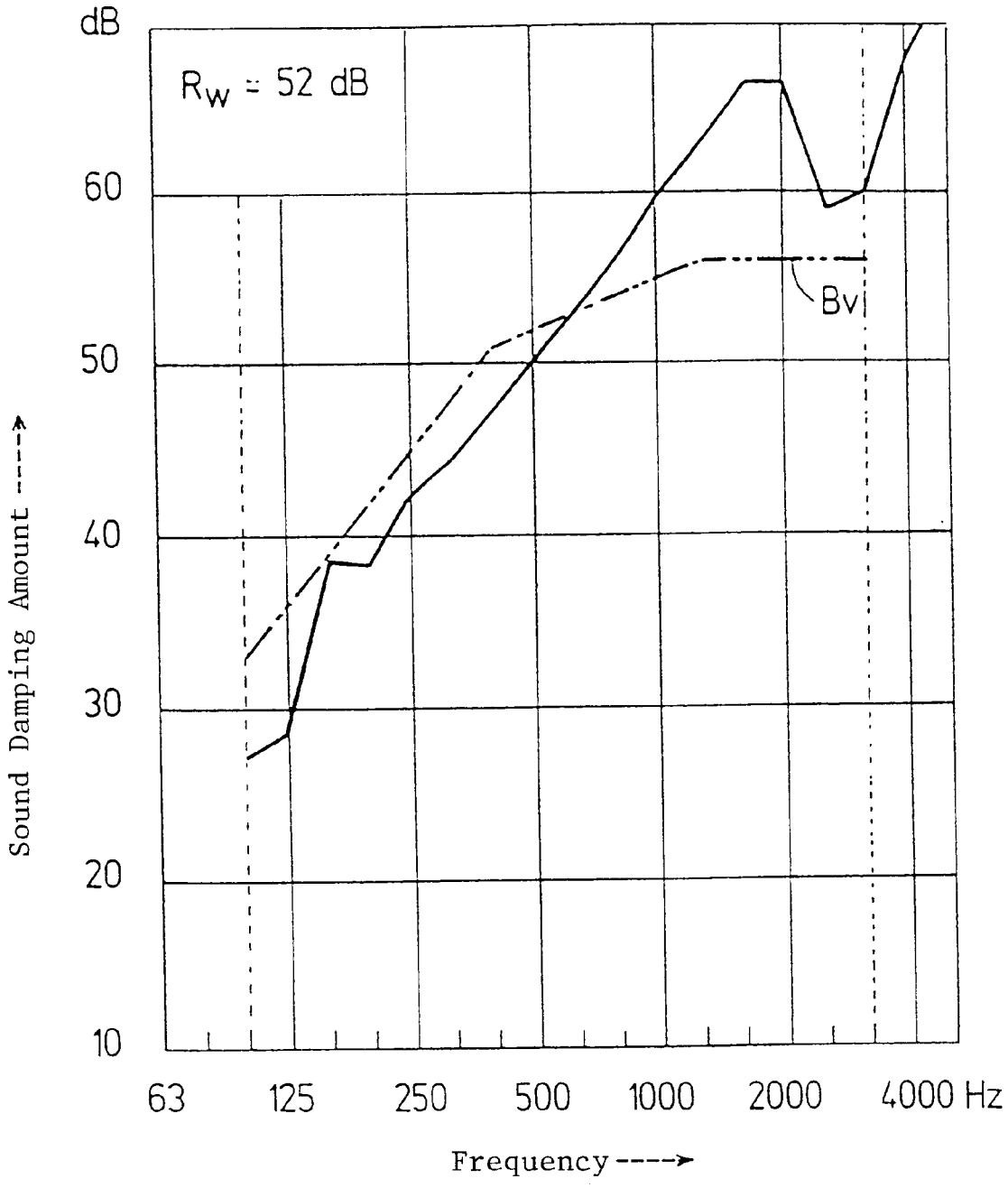
FIG. 3 shows a test diagram of the frequency dependent attenuation of airborne sound for a partition wall according to FIGS. 2*a* and *b*.
Figure 4:
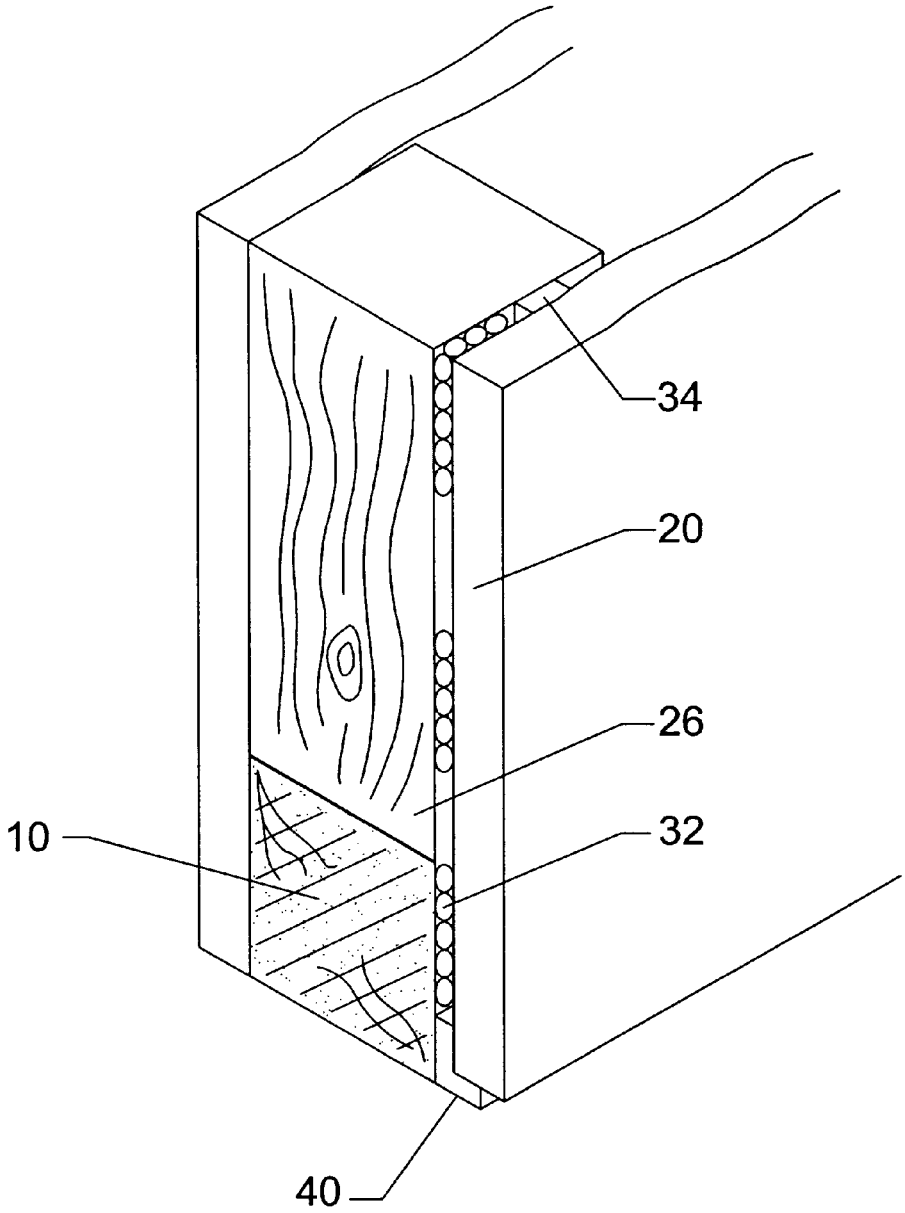
FIG. 4 shows a cross section and plan view of a stop shoulder for glued planking.

The examined partition wall had a surface area of 12.1 $m^2$ and a total weight (density) of 51.5 $kg/m^3$. The sound attenuation measurements were performed according to ISO/DIS 140-3 (1993) with an evaluation according to ISO/DIS 717-1 (1193) using wide band noise as test sound and a third-band filter on the receiver side. The results are shown in the diagram of FIG. 3. A comparison with the norm reference curve $B_v$ shown in dash-dotted line shows an average sound attenuation $R_w$=52 dB. This sound attenuation value is at least 6 dB larger than for a corresponding partition wall in which both plankings 18, 20 are stapled to the sub-frame.

In summary the following is to be stated: The invention is related to a sound-damping partition wall, especially for interior structures in buildings. The partition wall comprises a wooden sub-frame 10 and two sets of planking 18, 20 on either broad side 12, 14 of the sub-frame 10, leaving therebetween a hollow space 16 filled with air and damping material 36. In order to achieve improved sound damping properties by simple means it is proposed according to the invention that at one set of the planking 20 is connected to the sub-frame 10 by means of thick, softly elastic adhesive beads 32, while the other set of planking 18 is rigidly stapled to the sub-frame 10.

What is claimed is:

1. A sound-damping partition wall, especially for interior structures in buildings, comprising a sub-frame (10), and two sets of planking (18, 20), one on either broad side (12, 14) of the sub-frame, defining therebetween a hollow space filled with air and/or damping material, wherein at least one set of the planking (20) is connected to the sub-frame (10) by means of thick, softly elastic adhesive beads (32), wherein the adhesive has a hardness of 10 to 30 Shore (A).

2. The sound-damping partition wall of claim 1, wherein the adhesive has a shear modulus (G) of 0.1 to 0.3 $N/mm^2$.

3. The sound-damping partition wall according to claim 1, wherein the adhesive beads have a thickness of 3 to 10 mm.

4. The sound-damping partition wall according to claim 1 wherein the thickness of the adhesive beads is 0.3 to 1.2 times their width.

5. The sound-damping partition wall according to claim 1, wherein the adhesive beads have a thickness of 5 to 7 mm.

6. The sound-damping partition wall according to claim 1, wherein one of the two sets of planking (18) rigidly connected to the sub-frame.

7. The sound-damping partition wall according to claim 1 wherein the adhesive surface areas (A) of the adhesive beads are dimensioned such that under the influence of the weight of the planking a shear deformation of the adhesive beads of 5 to 25% of the bead thickness results.

8. The sound-damping partition wall according to claim 1 wherein the adhesive beads (32) have essentially rectangular adhesive surfaces.

9. The sound-damping partition wall of claim 8, wherein the rectangular adhesive surfaces of the adhesive bead (32) have a length (L), a width (W), and an aspect ration (L):(W) of 4:1 to 16:1.

10. The sound-damping partition wall according to claim 1, wherein the long sides of the adhesive beads (32) are vertically aligned with respect to the sub-frame (10).

11. The sound-damping partition wall according to claim 1, wherein the adhesive beads (32) are disposed vertically spaced with respect to each other on the vertical posts (26) of the sub-frame (10).

12. The sound-damping partition wall according to claim 1, wherein two laterally spaced rows of adhesive beads are disposed on each post (26) of the sub-frame.

13. The sound-damping partition wall of claim 12, wherein adjacent adhesive beads (32) of the two rows of adhesive beads are staggered in a zig-zag fashion with respect to each other.

14. The sound-damping partition wall according to claim 1 wherein double-sided foam adhesive strips acting as an aid during assembly provided in addition to the adhesive beads.

15. The sound-damping partition wall according to claim 1 wherein the adhesive is chosen from the group of polyurethane adhesives, silicone adhesives, butylene adhesives or a mixture of the adhesives.

16. The sound-damping partition wall according to claim 1 wherein the plankings consist of a single layer or of a multitude of layers.

17. The sound-damping partition wall according to claim 1 wherein the plankings (18, 20) consist or are composed of gypsum plaster boards, gypsum fiber boards, particle boards or plywood boards.

18. The sound-damping partition wall according to claim 1, wherein the subframe (10) is wooden.

19. The sound-damping partition wall according to claim 1, wherein a stop shoulder (40) for the glued planking (20) disposed on the sub-frame (10).

20. The sound-damping partition wall of claim 19, wherein the stop shoulder (40) is elastically resillient.

21. The sound-damping partition wall according to claim 19, wherein the stop shoulder (40) is disposed below the lower edge of the glued planking (20) and projects outward a distance corresponding to at least the bead thickness.

22. A sound-damping partition wall, especially for interior structures in buildings, comprising a sub-frame (10) and two sets of planking (18, 20), one on either broad side (12, 14) of the sub-frame, defining therebetween a hollow space filled with air and/or damping material, wherein at least one set of the planking (20) is connected to the sub-frame (10) by means of thick, softly elastic adhesive bead (32) and that the adhesive surface areas (A) of the adhesive bead are dimensioned such that under the influence of the weight of the planking a shear deformation of the adhesive beads of 5 to 25% of the bead thickness results.

23. The sound-damping partition wall according to claim 22, where the adhesive surface area of the adhesive beads (32) as a function of a unit area of the planking (20) is $$A=1/\mu\times F/G$$

with $\mu$=0.05 to 0.25, wherein F denotes the weight per unit area of the planking (20), G the shear modulus of the adhesive and $\mu$ the shear deformation of the adhesive beads (32) as a function of the bead thickness.

24. The sound-damping partition wall according to claim 22 wherein for a given bead size having an adhesive surface area A' per bead the number of beads per surface unit is $$n=1/\mu A'\times F/G$$

with $\mu$=0.05 to 0.25.

25. The sound-damping partition wall according to claim 22, wherein the subframe (10) is wooden.

26. A sound-damping partition wall, especially for interior structures in buildings, comprising a sub-frame (10) and two sets of planking (18, 20) on either broad side (12, 14) of the sub-frame, defining therebetween a hollow space filled with air and/or damping material, wherein at least one set of the planking (20) is connected to the sub-frame (10) by means of thick, softly elastic adhesive beads (32) and that the adhesive surface area of the adhesive bead (32) as a function of a unit area of the planking (20) is $$A=1/\mu F/G$$

with $\mu$=0.05 to 0.25, wherein F denotes the weight per unit area of the planking (20), G the shear modulus of the adhesive and $\mu$ the shear deformation of the adhesive beads (32) as a function of the bead thickness.

27. The sound-damping partition wall according to claim 26, wherein the subframe (10) is wooden.

* * * * *